US011661764B2

(12) United States Patent
Riesel et al.

(10) Patent No.: US 11,661,764 B2
(45) Date of Patent: May 30, 2023

(54) CROSS-SECTIONAL PROFILE FOR A FLAT KEY OR THE KEY CHANNEL OF A CYLINDER LOCK

(71) Applicant: EVVA Sicherheitstechnologie GmbH, Vienna (AT)

(72) Inventors: Michael Riesel, Weida (DE); Florian Oberleitner-Leeb, Vienna (AT); Walter Baumhauer, Horn (AT)

(73) Assignee: EVVA Sicherheitstechnologie GmbH, Vienna (AT)

( * ) Notice: Subject to any disclaimer, the term of this patent is extended or adjusted under 35 U.S.C. 154(b) by 0 days.

(21) Appl. No.: 17/797,176

(22) PCT Filed: Apr. 12, 2021

(86) PCT No.: PCT/EP2021/059439
§ 371 (c)(1),
(2) Date: Aug. 3, 2022

(87) PCT Pub. No.: WO2021/228478
PCT Pub. Date: Nov. 18, 2021

(65) Prior Publication Data

US 2023/0056247 A1 Feb. 23, 2023

(30) Foreign Application Priority Data

May 12, 2020 (AT) ..... A 50406/2020

(51) Int. Cl.
*E05B 19/00* (2006.01)
*E05B 27/00* (2006.01)

(52) U.S. Cl.
CPC ..... *E05B 19/0041* (2013.01); *E05B 19/0029* (2013.01); *E05B 27/0007* (2013.01); *E05B 27/0078* (2013.01)

(58) Field of Classification Search
CPC ..... E05B 19/0017; E05B 19/0029; E05B 19/0041; E05B 19/0076; E05B 27/0007; E05B 27/0078; E05B 27/02; E05B 27/08
See application file for complete search history.

(56) References Cited

U.S. PATENT DOCUMENTS 1,328,074 A 1/1920 Bennett
1,669,115 A 5/1928 Anakin
(Continued)

FOREIGN PATENT DOCUMENTS

AT 260041 2/1968
AT 389559 12/1989
(Continued)

OTHER PUBLICATIONS

Internationaler Recherchenbericht und Schriftlicher Bescheid [International Search Report and the Written Opinion] dated Nov. 4, 2015 From the International Searching Authority Re. Application No. PCT/EP2015/069843 and Its Translation of search Report Into English. (7 Pages).
(Continued)

*Primary Examiner* — Christopher J Boswell

(57) ABSTRACT

The invention relates to a cross-sectional profile (1) for a flat key or the keyway of a cylinder lock, comprising a back surface (2), a first lateral surface (4) and a second lateral surface (4'), wherein the lateral surfaces (4, 4') extend in the vertical direction to the back surface (2), the lateral surfaces (4, 4') are arranged offset to one another by a distance (5), which varies along their extension, and the outline of the cross-sectional profile (1) defines a preferably substantially rectangular base profile (6), and wherein the lateral surfaces (4, 4') each extend at least in sections along sinusoidal profiling lines (7, 7'), wherein the centerlines (8, 8') of the profiling lines (7, 7') lie within the base profile (6). Further, the invention relates to a flat key (16) with such a cross-
(Continued)

sectional profile (1) and a cylinder lock with a keyway (13) for receiving such a flat key (16).

22 Claims, 8 Drawing Sheets

(56) References Cited

U.S. PATENT DOCUMENTS

| | | | | |
|---|---|---|---|---|
| 2,023,207 | A | 12/1935 | Olson | |
| 3,035,433 | A | 5/1962 | Testa | |
| 3,264,852 | A | 8/1966 | Gysin | |
| 3,393,542 | A | 7/1968 | Crepinsek | |
| 3,499,304 | A * | 3/1970 | Naujoks | E05B 27/0053 70/406 |
| 3,742,744 | A | 7/1973 | Lumme | |
| 4,270,372 | A | 6/1981 | Vonlanthen et al. | |
| 4,416,128 | A * | 11/1983 | Steinbrink | E05B 19/0029 70/409 |
| 4,612,787 | A | 9/1986 | Prunbauer et al. | |
| 4,787,225 | A * | 11/1988 | Hauser | E05B 19/0017 70/393 |
| 4,977,767 | A | 12/1990 | Prunbauer | |
| 5,349,830 | A | 9/1994 | Keller | |
| 5,797,287 | A | 8/1998 | Prunbauer | |
| 5,956,986 | A | 9/1999 | Vonlanthen | |
| 6,041,631 | A | 3/2000 | Vonlanthen | |
| 6,758,074 | B1 | 7/2004 | Prunbauer | |
| 7,100,409 | B2 * | 9/2006 | Chang | E05B 27/00 70/358 |
| 7,207,200 | B2 | 4/2007 | Eden, Jr. et al. | |
| 7,412,860 | B1 * | 8/2008 | Field | E05B 19/0029 70/420 |
| 8,276,419 | B2 | 10/2012 | Farrenkothen et al. | |
| 8,726,706 | B2 | 5/2014 | Jacob | |
| 8,826,707 | B2 | 9/2014 | Habecke | |
| 8,931,316 | B2 * | 1/2015 | Reine | E05B 27/0078 409/83 |
| 9,200,474 | B1 * | 12/2015 | Chen | E05B 27/0057 |
| 2003/0089149 | A1 | 5/2003 | Suzuki et al. | |
| 2003/0101783 | A1 | 6/2003 | Kleinhani | |
| 2006/0236733 | A1 | 10/2006 | Walter | |
| 2007/0295045 | A1 * | 12/2007 | Neumayer | E05B 19/0029 70/409 |
| 2011/0126600 | A1 | 6/2011 | Baumhauer | |
| 2011/0302972 | A1 | 12/2011 | Higuchi | |
| 2013/0091911 | A1 | 4/2013 | Dolev | |
| 2013/0192320 | A1 | 8/2013 | Dalton, Jr. et al. | |
| 2016/0290007 | A1 | 10/2016 | Ojeda Gonzalez-Posada et al. | |
| 2017/0306649 | A1 | 10/2017 | Baumhauer | |
| 2019/0093390 | A1 | 3/2019 | Baumhauer | |

FOREIGN PATENT DOCUMENTS

| | | | |
|---|---|---|---|
| AT | 396501 | 10/1993 | |
| AT | 501706 | 10/2006 | |
| AT | 516237 | 3/2016 | |
| AT | 523800 | 6/2022 | |
| CN | 106968518 | 7/2017 | |
| DE | 515431 | 1/1931 | |
| DE | 2627764 | 1/1977 | |
| DE | 19654136 | 6/1998 | |
| DE | 19707932 | 9/1998 | |
| DE | 10134894 | 3/2002 | |
| DE | 10134894 A1 * | 3/2002 | E05B 19/0029 |
| DE | 10306371 | 9/2004 | |
| DE | 212004000034 | 11/2005 | |
| DE | 102006002726 | 8/2007 | |
| DE | 102009026117 | 1/2011 | |
| DE | 102010052473 | 6/2011 | |
| DE | 102010001790 | 8/2011 | |
| DE | 102013002721 | 8/2014 | |
| DE | 102015106353 | 10/2016 | |
| DE | 102015106353 A1 * | 10/2016 | E05B 19/0029 |
| EP | 0210037 | 1/1987 | |
| EP | 0335069 | 10/1989 | |
| EP | 0440983 | 8/1991 | |
| EP | 0613987 | 9/1994 | |
| EP | 1712714 | 10/2006 | |
| EP | 1492929 | 7/2013 | |
| EP | 2626488 | 8/2013 | |
| EP | 3088640 | 11/2016 | |
| EP | 3366871 | 8/2018 | |
| EP | 3428371 | 1/2019 | |
| EP | 3306017 | 10/2019 | |
| RU | 2114969 | 7/1998 | |
| WO | WO 91/10795 | 7/1991 | |
| WO | WO 2006/098675 | 9/2006 | |
| WO | WO 2006/108656 | 10/2006 | |
| WO | WO 2007/082580 | 7/2007 | |
| WO | WO 2011/098405 | 8/2011 | |
| WO | WO 2016/037882 | 3/2016 | |
| WO | WO 2017/006356 | 1/2017 | |
| WO | WO 2020/001901 | 1/2020 | |

OTHER PUBLICATIONS

Internationaler Recherchenbericht und Schriftlicher Bescheid [International Search Report and the Written Opinion] dated May 23, 2017 From the International Searching Authority Re. Application No. PCT/EP2017/055628 and Its Translation of Search Report Into English. (10 Pages).

Internationaler Recherchenbericht und Schriftlicher Bescheid [International Search Report and the Written Opinion] dated Jun. 24, 2021 From the International Searching Authority Re. Application No. PCT/EP2021/065499 and Its Translation of Search Report Into English. (11 Pages).

Internationaler Recherchenbericht und Schriftlicher Bescheid [International Searching Report and the Written Opinion] dated Sep. 4, 2019 From the International Searching Authority Re. Application No. PCT/EP2019/063817 and Its Translation of Search Report Into English. (12 Pages).

Notice Of Allowance dated Sep. 9, 2019 From the Re. U.S. Appl. No. 15/509,858 (5 pages).

Notice Of Allowance dated Dec. 23, 2019 From the Re. U.S. Appl. No. 16/082,283. (5 pages).

Official Action dated Sep. 6, 2019 From the Re. U.S. Appl. No. 16/082,283. (16 pages).

Official Action dated Mar. 21, 2019 From the Re. U.S. Appl. No. 15/509,858. (15 pages).

Internationaler Recherchenbericht und Schriftlicher Bescheid [International Search Report and the Written Opinion] dated Jun. 24, 2021 From the International Searching Authority Re. Application No. PCT/EP2021/059439 and Its Translation of Search Report Into English. (10 Pages).

Internationaler Vorläufiger Bericht zur Patentierbarkeit [International Preliminary Report on Patentability] dated Sep. 29, 2021 From the International Preliminary Examining Authority Re. Application No. PCT/EP2021/059439. (14 Pages).

* cited by examiner

CROSS-SECTIONAL PROFILE FOR A FLAT KEY OR THE KEY CHANNEL OF A CYLINDER LOCK

RELATED APPLICATIONS

This application is a National Phase of PCT Patent Application No. PCT/EP2021/059439 having International filing date of Apr. 12, 2021, which claims the benefit of priority of Austria Patent Application No. A50406/2020 filed on May 12, 2020. The contents of the above applications are all incorporated by reference as if fully set forth herein in their entirety.

FIELD AND BACKGROUND OF THE INVENTION

The invention relates to a cross-sectional profile for a flat key or the keyway of a cylinder lock, to a flat key with such a cross-sectional profile, and to a cylinder lock with a keyway for receiving such a flat key.

Flat keys are known from the prior art which have coded lateral surfaces having longitudinal ribs or longitudinal grooves and extending in the longitudinal direction of the key shank. The cross-sectional profile of the key shank defines a key profile with two opposite lateral surfaces. The keyway of a cylinder lock suitable for this flat key must consequently have a keyway profile which allows the flat key to be inserted into the keyway; however, the keyway profile does not necessarily have to be identical to the key profile.

SUMMARY OF THE INVENTION

A different design of the key profile between different key families is referred to as profile variation and allows key hierarchies to be defined for hierarchically lockable locking systems. For example, some cylinder locks may have a keyway profile that allows the introduction of several different key profiles, while other cylinder locks only allow the introduction of one specific key profile.

The profile variation is usually independent of the actual coding of the key by the key features unique to each key, which are formed, for example, by locking notches, incision millings or magnetic elements and are read in the lock by corresponding scanning means, for example housing and core pins.

A major misuse scenario for cylinder locks of this type is what is referred to as electro-picking. In electro-picking, a wire is inserted into the keyway and set in motion upwards and downwards by an electric motor. The wire hits the scanning means, for example the core pins, and vibrates them and subsequently also the housing pins, so that the partition plane between the cylinder core and housing is released. This allows unauthorized persons to open the cylinder lock.

For example, DE 101 34 894 A1 shows a generic key profile for flat keys in which the profile variations are formed by providing or omitting surface sections arranged in a grid-like manner in the cross-sectional profile, which are formed by sinusoidally extending profiling lines. In order to impede electro-picking, the profiling lines extend across the centerline of the keyway so that the wire of the electro-picking tool gets caught on the remaining surface sections. Such a key profile is also referred to as paracentric key profile. However, this inevitably removes a lot of material from the key and greatly reduces the stability of the key.

The object of the invention is to overcome these and other disadvantages of the state of the art. Persons skilled in the art are to be provided with alternative designs for defining profile variations. The object of the invention is, among other things, to create a key profile for flat keys and matching cylinder locks which is structured as simply as possible and is inexpensive to manufacture, is robust against mechanical stresses, and also offers protection against misuse, in particular so-called electro-picking.

These and other objects are in particular solved by the features of the independent patent claims.

A cross-sectional profile according to the invention for a flat key or the keyway of a cylinder lock comprises a back surface, a first lateral surface and a second lateral surface, in particular an opposite lateral surface.

The lateral surfaces extend in the vertical direction to the back surface and are arranged offset from one another by a distance, which optionally varies along their extension. The outline of the cross-sectional profile forms a preferably substantially rectangular base profile. However, according to the invention, deviations from the rectangular shape are provided in sections, which means that the cross-sectional profile can also project beyond the base profile in sections.

According to the invention, the lateral surfaces of the cross-sectional profile each extend at least in sections along sinusoidal profiling lines, the centerlines of the profiling lines each lying within the base profile. With suitable dimensioning of the profiling lines, this allows the realization of paracentric profiles in which the lateral surfaces project beyond the centerline of the base profile. Further, sinusoidal profiling lines can be easily produced and easily varied, for example by changing the phase position of the sinusoidal curves relative to one another.

According to the invention, it may in particular be provided that the lateral surfaces each extend at least in sections along a single sinusoidal profiling line. In this case, a sinusoidal profiling line is defined for each lateral surface, along which the lateral surfaces extend at least in sections.

On the one hand, such a cross-sectional profile can form the cross-section of a profiled flat key. On the other hand, it may also form the cross-section of the keyway in the rotatable core of a cylinder lock.

According to the invention, it may be provided that the centerlines of the profiling lines are spaced apart and parallel to one another so that their distance corresponds approximately to the distance of the lateral surfaces. In this case, the phase shift of the profiling lines is thus approximately zero, and their distance corresponds approximately to the thickness of the key or the keyway.

According to the invention, it may be provided that the centerlines of the profiling lines do not extend parallel to one another.

For example, the profiling lines may extend at an angle $\alpha$ to the center plane of the base profile, which is preferably approximately 5°, wherein the profiling lines approach one another linearly along their extension from the back surface. In this case, the key is thus wider in the area of its back surface than in the area of its key front, or the keyway is narrower in the area of the center of the cylinder core than in the area of the outer circumference of the cylinder core.

According to the invention, it may be provided that any number N, preferably two, of sinusoidal variation lines, which intersect the profiling lines, are provided in addition to the profiling lines, wherein, for forming variation ribs, the lateral surfaces extend at least in sections along one of the variation lines. That is, the intersections of the variation lines with the profiling lines form variation ribs. These may be selected to generate hierarchical key-lock families, that is, they may or may not be provided as required in a plurality of keys. The variation ribs are no key-specific codes.

The centerlines of the variation lines, like the centerlines of the profiling lines, preferably lie within the base profile. Preferably, the variation lines are not in phase, but offset by a phase offset of about 360°/N, particularly preferably about 180° if N=2.

In particular, it may be provided that, for forming first variation ribs, a number N1, preferably two, of sinusoidal first variation lines are provided on the first lateral surface, which are offset by a phase offset of about 360°/N1, particularly preferably about 180°, and that, for forming second variation ribs, a number N2, preferably two, of sinusoidal second variation lines are provided on the second lateral surface, which are offset by a phase offset of about 360°/N2, particularly preferably about 180°. For example, two variation lines, which are each offset by 180° with respect to one another, may be provided on each of the two sides.

The centerlines of the variation lines may coincide and lie in the center plane of the base profile. However, in other embodiments of the invention, the centerlines of the variation lines may lie outside the center plane of the base profile. The centerlines of the variation lines may be parallel to the center plane of the base profile, but they may also be at an angle β to the center plane of the base profile, which is preferably approximately 5°, and linearly diverge in their extension from the back surface. The profiling lines and the variation lines preferably have substantially the same period duration T. A first variation line may have a phase shift in the range of about 75° to about 105°, preferably about 90°, with respect to a first profiling line.

Preferably, the amplitude of the profiling lines is at least half of the distance of the lateral surfaces. In other words, the amplitude is at least half the material thickness of the key shank or at least half the width of the keyway. This ensures that the cross-sectional profile is paracentric, i.e., the lateral surfaces project in sections beyond the centerline of the base profile, making it more difficult to pick the lock. The profiling lines and the variation lines may have substantially the same amplitude. However, it may also be provided that the profiling lines and the variation lines have a different amplitude, at least in sections. In this case, it may be provided that the profiling lines project in sections beyond the base profile, i.e., the outline of the cross-sectional profile. On the key, this design is expressed by a projecting profile rib, and in the keyway by a correspondingly wide profile groove.

Further, the invention relates to a flat key with a cross-sectional profile according to the invention. Such a flat key comprises two longitudinally profiled key lateral surfaces, which extend at least in sections along the profiling lines and optionally variation lines of the cross-sectional profile, a key back surface and an optionally encoded key front surface. According to the invention, the profile ribs and the variation ribs extend along the entire shank on both sides of the flat key.

The flat key may have a key bow and a key tip, wherein, in possible embodiments of the invention, the amplitudes of the profiling lines and the variation lines are smaller in the area of the key tip than in the area of the key bow. In other words: The flat key is narrower in the area of its tip than in the area of its bow, wherein no changes are provided in the positioning and the extension of its profile ribs and variation ribs; only the amplitudes of the profiling lines and the variation lines are reduced. For example, the flat key may be designed about 20% to about 80% narrower in the area of the key tip than in the area of the key bow. The narrower area can, for example, extend over a distance of 20% to 50% of the length of the flat key, wherein the transition to the thicker area can be abrupt or smooth.

According to the invention, it may also be provided that the amplitudes of the profiling lines and the variation lines of the cross-sectional profile of a flat key according to the invention are reduced only in sections in the area between the key tip and the key bow, in particular by about 20% to 80%. Those points at which the amplitudes are reduced may preferably be areas of scanning positions at which the flat key has codes for being read in the associated cylinder lock. In these embodiments, the flat key is thus narrower in sections, so that the scanning elements in the associated cylinder lock must be designed correspondingly in order to be able to scan the codes on the narrow key shank. This is independent of the design of the keyway, which, in order to allow insertion of the flat key, must be dimensioned with amplitudes of the profiling and variation lines that at least match or exceed those of the flat key.

The invention further relates to a cylinder lock having a keyway for receiving a flat key, the keyway being formed with a cross-sectional profile according to the invention. Consequently, the keyway comprises two lateral surfaces, which extend at least in sections along the profiling lines and optionally the variation lines of the cross-sectional profile.

According to the invention, it may be provided that at least one lateral surface of the keyway has a trapping calotte to prevent or impede electro-picking. The trapping calotte may be designed as a sinusoidal undercut of the lateral surface around a baseline. That is, the lateral surface of the keyway does not extend exactly along the predetermined sinusoidal profiling line or variation line, but has an undercut. Preferably, this undercut may extend along the entire length of the keyway, i.e., over all scanning positions in the cylinder core, to make electro-picking more difficult at each scanning position. In possible embodiments, the predetermined profiling line or variation line of a lateral surface may serve as the baseline of the sinusoidal undercut. Preferably, the design of the sinusoidal undercut is selected such that it can be well integrated into the predetermined profiling line or variation line of the lateral surface. For example, the amplitude of the sinusoidal undercut may be less than the amplitude of the profiling line, for example about 20% to 50% of the amplitude of the profiling line.

The baseline may extend at an angle of about 60° to about 90° to the center plane of the base profile of the cross-sectional profile. This angle depends primarily on the positioning of the trapping calotte along the profiling line.

For reading codes on the key front surface of a flat key according to the invention, at least one core pin may be provided in a cylinder lock according to the invention, which core pin is of hip-shaped design at its end projecting into the keyway and has a scanning surface. The scanning surface may be designed symmetrically or optionally also asymmetrically with respect to the longitudinal axis of a substantially cylindrical base body of the core pin. The scanning surface may extend linearly substantially along the entire diameter of the cylindrical base body. The scanning surface may also extend linearly along a portion of the diameter of the cylindrical base body. In the cylinder lock, also differently designed core pins, for example core pins with a symmetrically designed scanning surface and core pins with an asymmetrically designed scanning surface, may be provided.

The invention further relates to a locking system comprising one or more flat keys according to the invention and one or more cylinder locks according to the invention.

In particular, it may be provided that a locking hierarchy is formed by designing the cross-sectional profiles of the flat keys and those of the cross-sectional profiles of the keyways differently and hierarchically. For example, individual cylinder locks can be designed with keyways that only allow the insertion of selected flat keys, and other cylinder locks can have keyways in which (for example, by milling out all variation ribs) all flat keys can be inserted. The design of such hierarchical key families is basically known to the skilled person.

In preferred embodiments of the locking system, it may be provided that the flat key has a cross-sectional profile in which the centerlines of the variation lines lie outside the center plane of the base profile, and that the cylinder lock comprises at least one core pin which is of hip-shaped design at its end projecting into the keyway in order to scan the codes of the flat key lying outside the center plane of the base profile.

BRIEF DESCRIPTION OF THE SEVERAL VIEWS OF THE DRAWINGS

Further features according to the invention optionally emerge from the claims, the description of the exemplary embodiments, and the figures.

The invention is now further explained on the basis of non-exclusive and/or non-limiting exemplary embodiments.

DESCRIPTION OF SPECIFIC EMBODIMENTS OF THE INVENTION

Figure 1A:
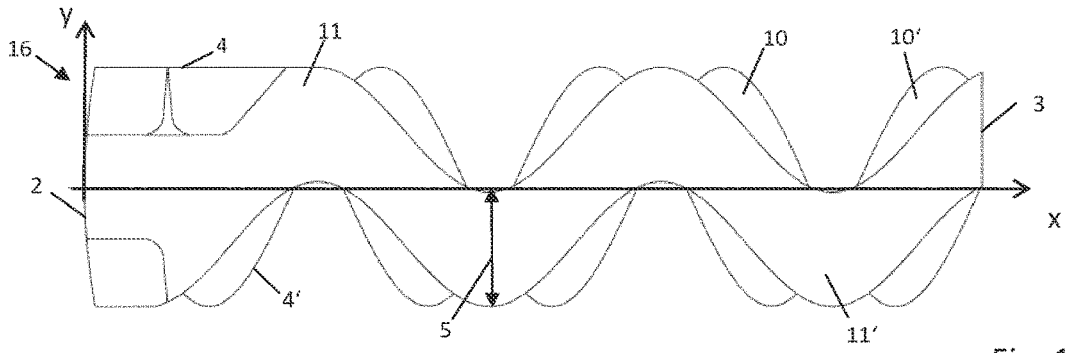
FIGS. 1*a* to 1*c* show views of an embodiment of a cross-sectional profile according to the invention.
Figure 1B:
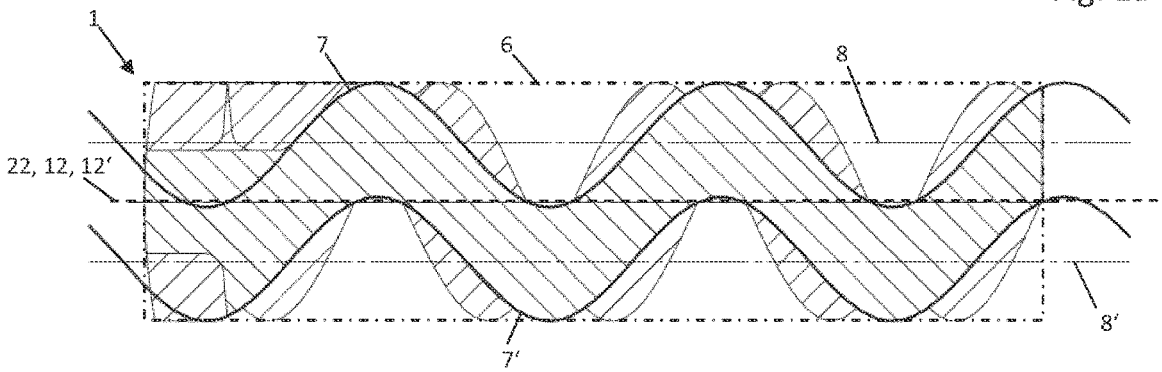
Figure 1C:
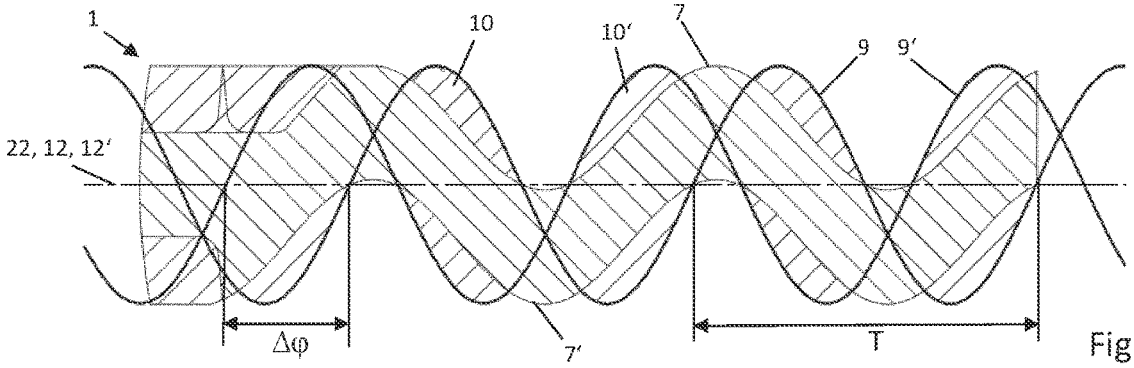

FIGS. 1*a* to 1*c* show views of an embodiment of a cross-sectional profile 1 according to the invention, wherein FIG. 1*a* shows the cross-section of a resulting flat key, while FIG. 1*b* and FIG. 1*c* show the designs of the profiling lines and the variation lines.

The cross-sectional profile 1 comprises a back surface 2, an upper first lateral surface 4 and a lower second lateral surface 4'. The two lateral surfaces 4, 4' extend in the vertical direction, i.e., in the normal direction or at an angle of 90°, to the back surface 2. The lateral surfaces 4, 4' are arranged offset to one another by a distance 5, which, in this exemplary embodiment, is constant along their extension. In the design as a flat key, the distance 5 is the material thickness of the flat key. The outline of the cross-sectional profile 1 defines a substantially rectangular base profile 6, which is shown purely schematically in FIG. 1*b*.

The lateral surfaces 4, 4' each extend in sections along sinusoidal profiling lines 7, 7'/sinusoidal variation lines 9, 9'.

The profiling lines 7, 7' and the variation lines 9, 9' are schematic construction lines which are typically realized only in sections on the flat key or in the keyway and which are used when defining the key profiles in order to form profile ribs 11, 11' and variation ribs 10, 10'. The centerlines 8, 8' of the profiling lines 7, 7' extend at a distance and parallel to one another within the base profile 6. Thus, the distance of the profiling lines 7, 7' corresponds approximately to the distance 5 of the lateral surfaces 4, 4'. In addition to the profiling lines 7, 7', two sinusoidal variation lines 9, 9' are provided, which intersect the profiling lines 7, 7'.

The intersections form the variation ribs 10, 10' in that the lateral surfaces extend along one of the variation lines 9, 9' in these sections and not along the profiling lines 7, 7'. In this exemplary embodiment, the centerlines 12, 12' of the variation lines 9, 9' lie within the base profile 6, i.e. on the centerline 22 of the base profile 6. The variation lines 9, 9' are offset by a phase offset $\Delta\varphi$ of about 180°, wherein the periods T of the profiling lines and the variation lines are substantially identical.

Figure 2:
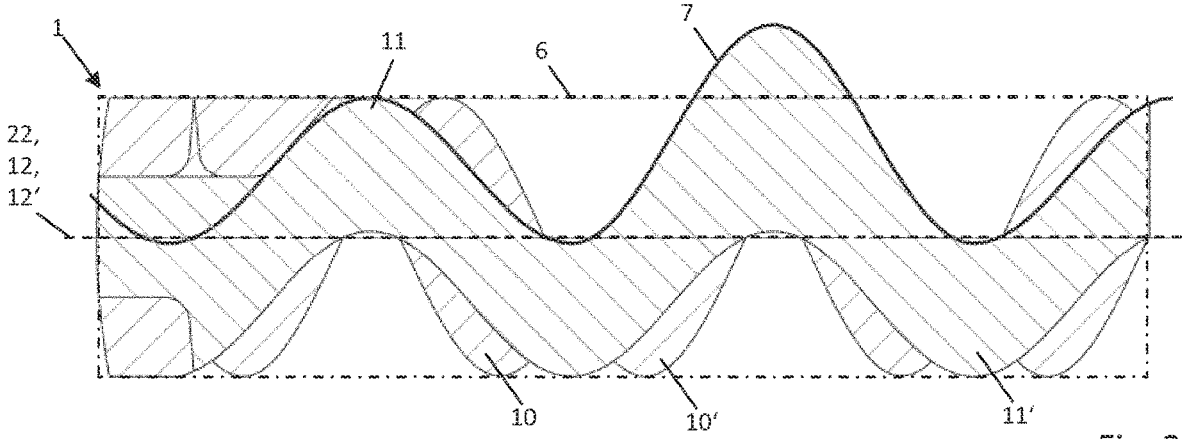
FIG. 2 shows a view a further embodiment of a cross-sectional profile according to the invention.

FIG. 2 shows a view of a further embodiment of a cross-sectional profile 1 according to the invention. In this embodiment, the amplitude of the profiling lines 7, 7' and the variation lines 9, 9' differs in sections. In this specific example, one of the profiling lines 7 exceeds the base profile 6 in one section of the lateral surface 4.

Figure 3A:
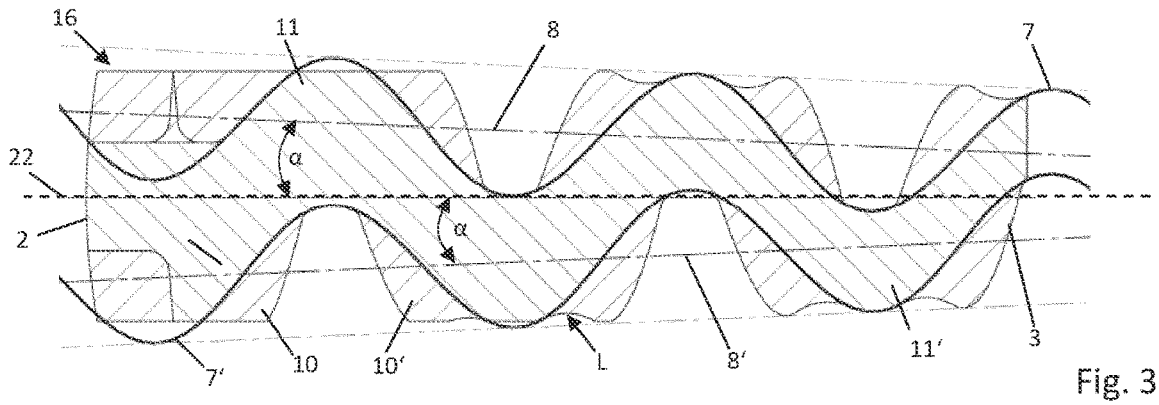
FIGS. 3*a* to 3*b* show views of an embodiment of a cross-sectional profile according to the invention.
Figure 3B:
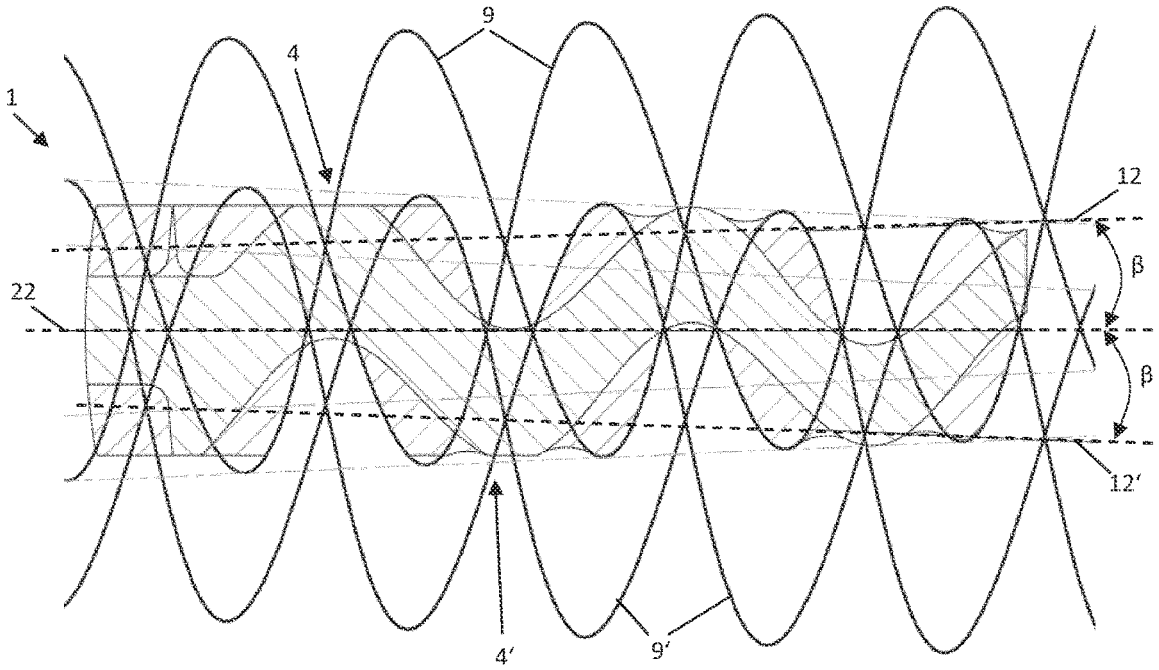

FIGS. 3*a* to 3*b* show views of a further embodiment of a cross-sectional profile 1 according to the invention. This cross-sectional profile 1 has a base profile 6, which tapers slightly conically starting from the back surface 2, wherein this taper is approximately 5°. FIG. 3*a* shows a correspondingly designed flat key 16; FIG. 3*b* schematically shows the arrangement of the construction lines for this cross-sectional profile 1.

In this embodiment, the centerlines 8, 8' of the sinusoidal profiling lines 7, 7' extend at an angle $\alpha$ to the central plane 22 of the base profile 6, which is approximately 5°, and the profiling lines 7, 7' linearly approach one another along their extension from the back surface 2. In contrast, the centerlines 12, 12' of the variation lines 9, 9' extend in the exact opposite direction at an angle $\beta$ to the central plane 22 of the base profile 6, which is approximately 5°, wherein the variation lines 9, 9' linearly diverge in their extension from the back surface 2.

In the area of the first lateral surface 4, two sinusoidal first variation lines 9 are provided for forming first variation ribs 10, which are offset by a phase offset of about 180°.

Analogously, two sinusoidal second variation lines 9' are provided on the second lateral surface 4' for forming second variation ribs 10', which are offset by a phase offset of 180°. For their part, these two groups of variation lines are out of phase with one another in such a way that variation ribs 10, 10' are each defined alternately by one of the four variation lines 9, 9' both on the first lateral surface 4 and on the second lateral surface 4'. This allows a particularly easy and structured definition of a plurality of profile variations for forming profile hierarchies.

This exemplary embodiment also shows that the variation lines 9, 9' have a substantially bigger amplitude than the profiling lines 7, 7'. The advantage is that the pitch of the profile ribs 11, 11' is flatter than the pitch of the variation ribs 10, 10'. This is particularly clearly visible in FIG. 3*a*. Consequently, a longitudinal groove L is formed between the tips of a profile rib 11, 11' and a variation rib 10, 10' in this embodiment, which can be used particularly advantageously for securely inserting the key into the keyway.

Figure 4A:
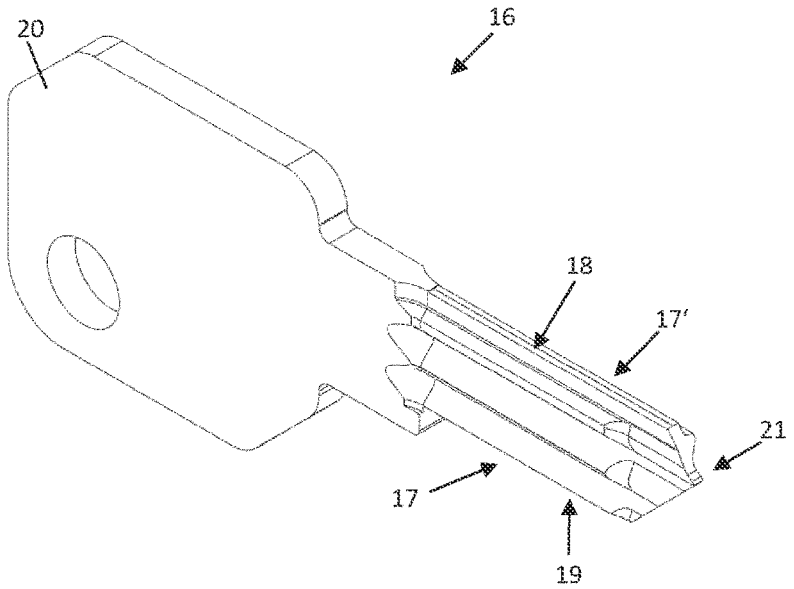
FIGS. 4*a* to 4*b* show views of an embodiment of a key according to the invention and a keyway according to the invention.
Figure 4B:
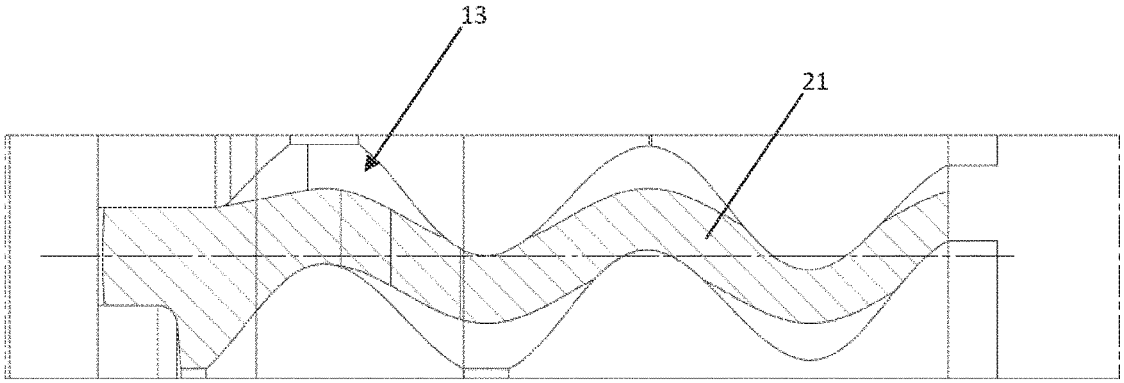

FIGS. 4*a* to 4*b* show views of an embodiment of a key 16 according to the invention and a keyway 13 according to the invention. The flat key 13 comprises two longitudinally profiled key lateral surfaces 17, 17', which extend in sections along the profiling lines 7, 7' and variation lines 9, 9' of the cross-sectional profile 1, a key back surface 18 and an optionally encoded key front surface 19.

Further, the flat key 16 comprises a key bow 20 and a key tip 21, wherein the amplitudes of the profiling lines 7, 7' and the variation lines 9, 9' are smaller in the area of the key tip 21 than in the area of the key bow 20, in particular smaller by about 50%. In this exemplary embodiment, the area of reduced amplitude extends over about 20% of the length of the key shank. FIG. 4*b* is a top view of the keyway 13 with the key inserted, wherein the key tip 21 is visible.

Figure 5:
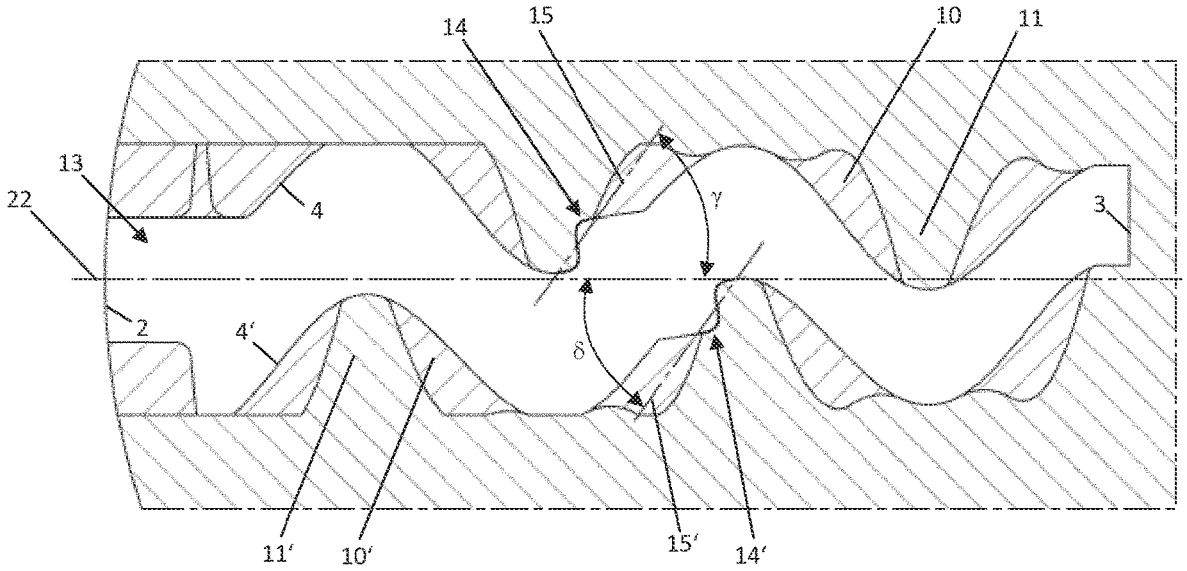
FIG. 5 shows a view of an embodiment of a keyway according to the invention.

FIG. 5 shows a view of an embodiment of a keyway 13 according to the invention in a cylinder lock designed to receive a flat key 16. The keyway 13 comprises two lateral surfaces 4, 4', which extend in sections along the profiling lines 7, 7' and variation lines 9, 9' of the cross-sectional profile 1, and has a rectangular base profile 6 with a centerline 22. The cross-sectional profile 1 is paracentric, since at least one of the profile ribs 11 projects beyond the baseline 22.

The two lateral surfaces 4, 4' each have a trapping calotte 14, 14', which is designed as a sinusoidal undercut around a baseline 15, 15'. This makes it more difficult to scan the codes in the cylinder core (which, in the present embodiment, are located on the right-hand side). The needles of the electro-picking tool would be inserted from the left, i.e., the area of the back surface 2, and attempt to advance to the area of the front surface 3, i.e., to the right. As these scanning needles move back, they get caught on the trapping calottes, causing the scanning attempt to fail.

However, since the trapping calottes 14, 14' are formed as undercuts, i.e., cutouts of the profile ribs 11, 11', they do not interfere with the insertion of an authorized key into the keyway 13. In this exemplary embodiment, the baselines 15, 15' extend along the profiling line 7, 7' of the lateral surface of the keyway 13 provided at this point.

In this exemplary embodiment, the baselines 15, 15' of the sinusoidal undercuts extend at an angle $\gamma$ or $\delta$ of about 60° to about 90° to the center plane 22 of the base profile 6 of the cross-sectional profile 1. The amplitudes of the undercuts forming the trapping calottes 14, 14' are substantially smaller than the amplitudes of the profiling lines 7, 7' and approximately in the range of 10% to 20% thereof.

Figure 6A:
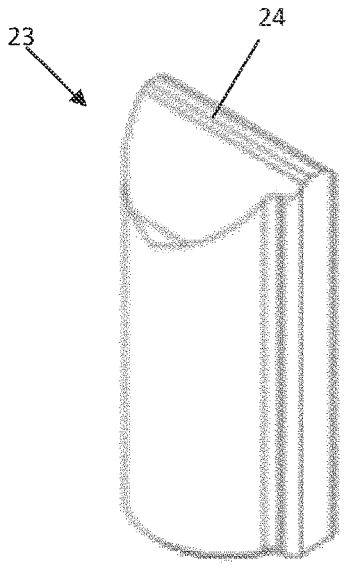
FIGS. 6*a* to 6*c* show a schematic three-dimensional view and schematic lateral views of a first embodiment of a core pin for a cylinder lock according to the invention.
Figure 6B:
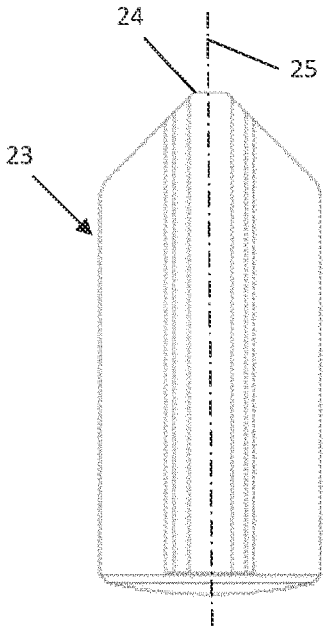
Figure 6C:
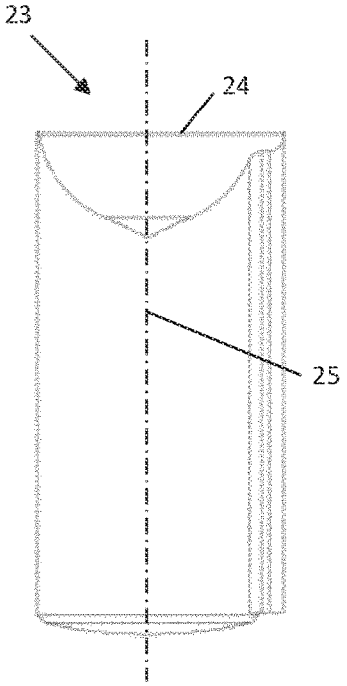

FIGS. 6*a* to 6*c* show a schematic three-dimensional view and schematic lateral views of a first embodiment of a core pin 23 for a cylinder lock according to the invention. In this exemplary embodiment, the cylinder lock is designed to read codes on the key front surface 19 of a flat key 16 according to the invention. For this purpose, core pins 23 with a special geometry are provided which project into the keyway 13. At least one of the core pins 23 is of hip-shaped design at its end projecting into the keyway 13 and has a scanning surface 24. The specially shaped, hip-shaped end region enables the scanning surface 24 to selectively scan codes of the key front surface 19. Conventional core pins with a conical tip and a substantially circular scanning surface, however, would get caught on the sinusoidally profiled lateral surfaces of the flat key 16 or at least provide an incorrect scanning result. In particular, if the tip angle, i.e., the angle at the conical tip of a conventional core pin, is too small, it would potentially get caught on the lateral surfaces. If the extent of the scanning surface of the conventional core pin is too large, it cannot follow the sinusoidal profiling of the flat key.

Figure 6D:
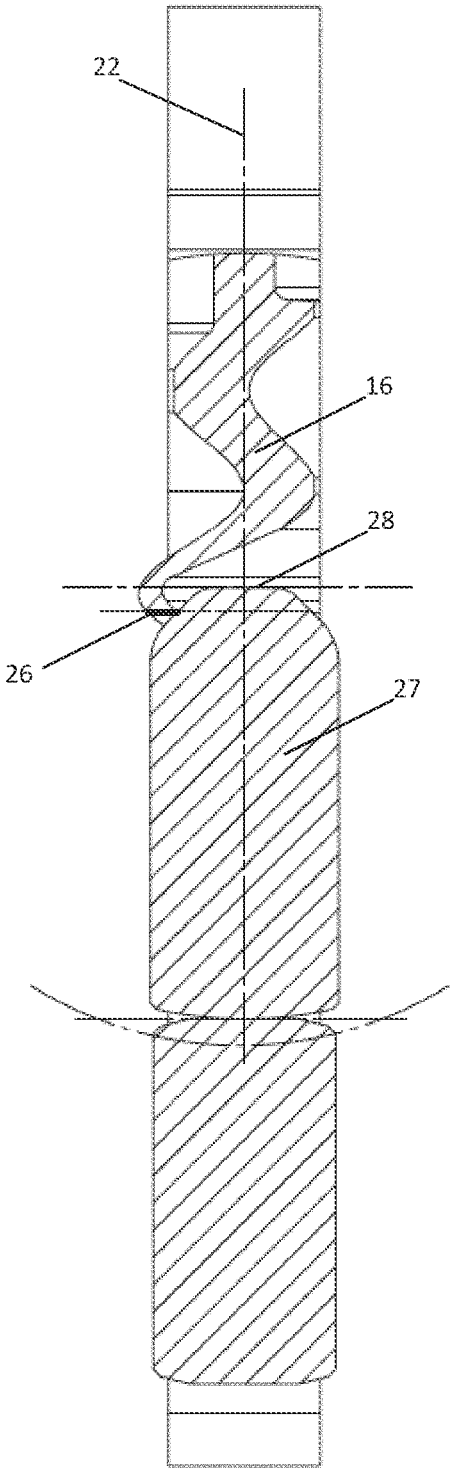
FIGS. 6*d* to 6*e* show a schematic sectional view of a cylinder lock and a flat key using a conventional core pin and a core pin according to the invention.
Figure 6E:
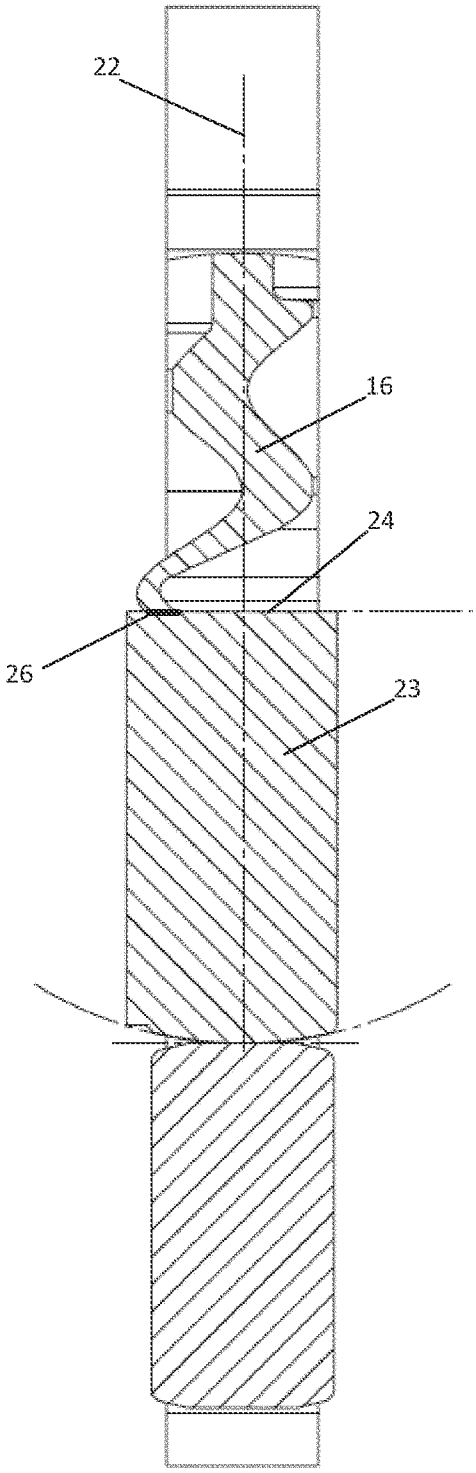

For clarification, this function is shown in simplified form in FIG. 6*d* and FIG. 6*e* using the example of a flat key 16 according to the invention with a sinusoidal profiling. Due to the sinusoidal profiling, the code 26 is not located centrally at this scanning position of the flat key 16, but eccentrically to the center plane 22 of the base profile of the flat key 16. Consequently, the conventional core pin 27 shown in FIG. 6*d* with its conical tip and centered scanning surface 28 cannot read the actual code 26, but penetrates too far into the key profile. In contrast, the core pin 23 designed according to the embodiment shown in FIGS. 6*a* to 6*c* is of hip-shaped design at its end projecting into the keyway 13 and has a scanning surface 24, which extends essentially linearly along its entire diameter. This specially designed hip-shaped end region enables the core pin 23 to correctly scan the eccentric codes 26 with its scanning surface 24.

In the exemplary embodiment of the core pins according to FIGS. 6*a* to 6*c*, the scanning surface 24 of the core pin 23 is designed substantially symmetrically to the longitudinal axis 25 of the base body of the core pin 23. The laterally arranged guide does not count as part of the base body. The lateral surfaces of the hip-shaped end form substantially identical angles of approximately 45° with the central longitudinal axis 25.

Figure 6F:
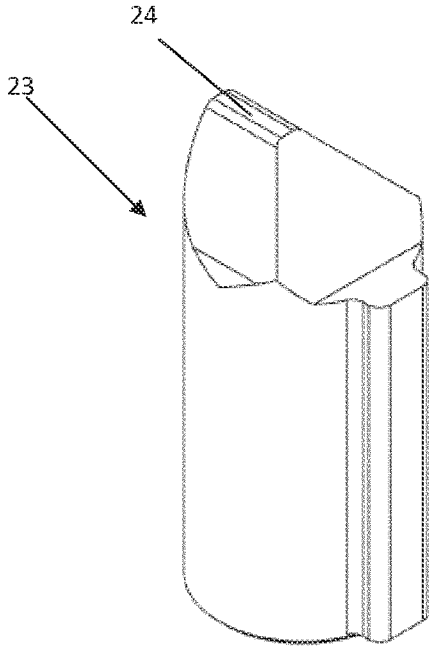
FIGS. 6*f* to 6*g* show a schematic three-dimensional view and a schematic lateral view of a second embodiment of a core pin for a cylinder lock according to the invention.
Figure 6G:
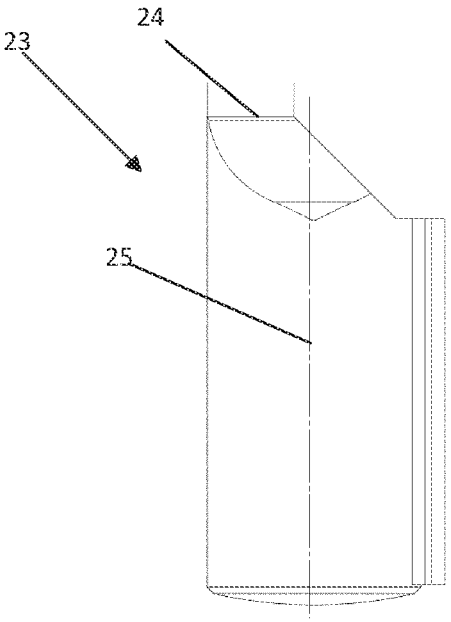

FIGS. 6*f* to 6*g* show a schematic three-dimensional view and a schematic lateral view of a second embodiment of a core pin 23 for a cylinder lock according to the invention. In this exemplary embodiment, the core pin 23 has a hip-shaped end region, which extends asymmetrically to the longitudinal axis 25 of the cylindrical base body.

The scanning surface 24 is located entirely on one side of the longitudinal axis 25 of the base body of the core pin 23 so that the lateral surfaces of the formed hip form different angles with the longitudinal axis 25. Thus, the scanning surface 24 is formed asymmetrically to the longitudinal axis 25. This allows the particularly targeted insertion of the scanning surface into a code on the key front surface 19 of the flat key 16.

Embodiments of cylinder locks according to the invention are also provided, in which both core pins with scanning surfaces 24 arranged symmetrically to the longitudinal axis 25 and core pins with scanning surfaces 24 arranged asymmetrically to the longitudinal axis 25 are provided.

The invention is not limited to the illustrated embodiments, but rather comprises any flat keys/cylinder locks or locking system according to the following patent claims. In particular, the optionally used term "incision milling" is not limited to cutouts formed by means of a milling tool but it comprises cutouts formed by any means.

LIST OF REFERENCE SIGNS

1 Cross-sectional profile
2 Back surface
3 Front surface
4 First lateral surface
4' Second lateral surface
5 Distance
6 Base profile
7, 7' Profiling lines
8, 8' Centerlines of the profiling lines

9, 9' Variation lines
10, 10' Variation ribs
11, 11' Profiling ribs
12, 12' Centerlines of the variation lines
13 Keyway
14, 14' Trapping calotte
15, 15' Baseline of the trapping calotte
16 Flat key
17, 17' Key lateral surface
18 Key back surface
19 Key front
20 Key bow
21 Key tip
22 Center plane of the base profile
23 Core pin
24 Scanning surface
25 Longitudinal axis of the core pin
26 Code
27 Conventional core pin
28 Scanning surface of the conventional core pin

The invention claimed is:

1. A cross-sectional profile (1) for a flat key or the keyway of a cylinder lock, comprising a back surface (2), a first lateral surface (4) and a second lateral surface (4'), wherein a. the lateral surfaces (4, 4') extend in the vertical direction to the back surface (2), b. the lateral surfaces (4, 4') are arranged offset to one another by a distance (5), which varies along their extension, c. the outline of the cross-sectional profile (1) defines a substantially rectangular base profile (6), d. wherein the lateral surfaces (4, 4') each extend at least in sections along sinusoidal profiling lines (7, 7'), and wherein e. the centerlines (8, 8') of the profiling lines (7, 7') lie within the base profile (6);

wherein the centerlines (8, 8') of the profiling lines (7, 7')

a. extend at an angle □ to the center plane (22) of the base profile (6), which is approximately 5°, and linearly approach one another along their extension from the back surface (2).

2. The cross-sectional profile (1) according claim 1, wherein, in addition to the profiling lines (7, 7'), any number N, of sinusoidal variation lines (9, 9'), which intersect the profiling lines (7, 7'), are provided, wherein a. for forming variation ribs (10, 10'), the lateral surfaces (4, 4') extend at least in sections along one of the variation lines (9, 9'), and b. the centerlines of the variation lines (9, 9') lie within the base profile (6), and c. the variation lines (9, 9') are offset by a phase offset.

3. The cross-sectional profile (1) according to claim 1, wherein a. for forming first variation ribs (10), a number N1 of sinusoidal first variation lines (9) are provided on a first lateral surface (4) from the lateral surfaces (4, 4'), which are offset by a phase offset, and b. for forming second variation ribs (10'), a number N2 of sinusoidal second variation lines (9') are provided on a second lateral surface (4') from the lateral surfaces (4, 4'), which are offset by a phase offset.

4. The cross-sectional profile (1) according to claim 1, wherein the centerlines (12, 12') of the variation lines (9, 9') coincide and lie in the center plane (22) of the base profile (6).

5. The cross-sectional profile (1) according to claim 1, wherein the centerlines (12, 12') of the variation lines (9, 9') lie outside the center plane (22) of the base profile (6).

6. The cross-sectional profile (1) according to claim 1, wherein the centerlines (12, 12') of the variation lines (9, 9')

a. extend at an angle □ to the center plane (22) of the base profile (6), which is approximately 5°, and b. linearly diverge in their extension from the back surface (2).

7. The cross-sectional profile (1) according to claim 1, wherein the profiling lines (7, 7') and the variation lines (9, 9') have substantially the same period duration T.

8. The cross-sectional profile (1) according to claim 1, wherein the amplitude of the profiling lines (7, 7') is at least half the distance (5) of the lateral surfaces (4, 4').

9. The cross-sectional profile (1) according to claim 1, wherein the profiling lines (7, 7') and the variation lines (9, 9') have substantially the same wherein amplitude.

10. The cross-sectional profile (1) according to claim 1, wherein the profiling lines (7, 7') and the variation lines (9, 9') have a different amplitude at least in sections.

11. A flat key (16) with a cross-sectional profile (1) according to claim 1, comprising two longitudinally profiled key lateral surfaces (17, 17'), which extend at least in sections along the profiling lines (7, 7') and the variation lines (9, 9') of the cross-sectional profile (1), a key back surface (18) and an encoded key front surface (19).

12. The flat key (16) according to claim 11, wherein the flat key (16) has a key bow (20) and a key tip (21), wherein the amplitudes of the profiling lines (7, 7') and the variation lines (9, 9') are smaller in the area of the key tip (21) than in the area of the key bow (20), smaller by about 20% to 80%.

13. The flat key (16) according to claim 12, wherein the amplitudes of the profiling lines (7, 7') and the variation lines (9, 9') are in sections reduced by about 20% to 80% in the area between the key tip (21) and the key bow (20), in the area of scanning positions at which a code is provided for being read in the associated cylinder lock.

14. A cylinder lock with a keyway (13) for receiving a flat key (16) according to claim 1, comprising two lateral surfaces, which extend at least in sections along one or more profiling lines (7, 7') and the variation lines (9, 9') of the cross-sectional profile (1).

15. The cylinder lock according to claim 14, wherein at least one lateral surface has a trapping calotte (14), which is designed as a sinusoidal undercut around a baseline (15, 15'), the baseline (15, 15') extending along a profiling line (7, 7') and/or variation line (9, 9') of the lateral surface.

16. The cylinder lock according to claim 15, wherein the baseline (15, 15') extends at an angle of about 60° to about 90° to the central plane (22) of the base profile (6) of the cross-sectional profile (1).

17. The cylinder lock according to claim 14, wherein, for reading codes on the key front surface (19) of a flat key (16) having the amplitudes of the profiling lines (7, 7') and the variation lines (9, 9') are in sections reduced by about 20% to 80% in the area between the key tip (21) and the key bow (20); wherein, at least one core pin (23) is provided, which is of hip-shaped design at its end projecting into the keyway (13) and has a scanning surface (24).

18. The cylinder lock according to claim 17, wherein the scanning surface (24) extends linearly substantially along the entire diameter of a cylindrical base body.

19. The cylinder lock according to claim 17, wherein the scanning surface (24) extends linearly along a section of the diameter of a cylindrical base body.

20. A locking system, comprising one or more flat keys (16) and cylinder locks according to claim 17.

21. The locking system according to claim 20, wherein a. the flat key (16) has a cross-sectional profile (1) in which the centerlines (12, 12') of the variation lines (9, 9') lie outside the center plane (22) of a base profile (6), and b. the cylinder lock comprises at least one core pin (23), which is of hip-shaped design at its end projecting into a keyway (13) in order to scan codes of the flat key (16) which lie outside the center plane (22) of the base profile (6).

22. The locking system according to claim 21, comprising multiple flat keys (16) and multiple cylinder locks, wherein a locking hierarchy is formed by designing the cross-sectional profiles (1) of the flat keys (16) and the cross-sectional profiles (1) of the keyways (13) differently and hierarchically.

* * * * *